US005188694A

United States Patent [19]

Hashida et al.

[11] Patent Number: 5,188,694

[45] Date of Patent: Feb. 23, 1993

[54] SHEET PERFORATING APPARATUS

[75] Inventors: Yoshisuke Hashida, Hino; Hideo Takaoka, Tokyo; Yoshiharu Kamei, Urawa, all of Japan

[73] Assignee: Sun Seiki Co., Ltd., Japan

[21] Appl. No.: 759,647

[22] Filed: Sep. 13, 1991

Related U.S. Application Data

[63] Continuation of Ser. No. 599,112, Oct. 17, 1990, abandoned.

[30] Foreign Application Priority Data

Oct. 18, 1989 [JP] Japan ..... 1-269102

[51] Int. Cl.[5] ..... B26D 5/00

[52] U.S. Cl. ..... 156/353; 156/261; 156/513; 156/514; 156/518; 156/542

[58] Field of Search ..... 156/518, 514, 353, 513, 156/530, 520, 541, 261, 352, 522, 566

[56] References Cited

U.S. PATENT DOCUMENTS

| | | | |
|---|---|---|---|
| 4,196,035 | 4/1980 | Reil | 156/518 |
| 4,409,062 | 10/1983 | Conti | 156/530 |
| 4,698,114 | 10/1987 | Lowe | 156/362 |
| 4,746,394 | 5/1988 | Sueta et al. | 156/514 |
| 4,822,446 | 4/1989 | Hansen | 156/514 |

*Primary Examiner*—David A. Simmons

*Assistant Examiner*—W. J. Matney, Jr.

*Attorney, Agent, or Firm*—Finnegan, Henderson, Farabow, Garrett & Dunner

[57] ABSTRACT

Disclosed herein is a sheet perforating apparatus comprising a sheet transfer mechanism; a perforating section for boring at least one filing hole in a sheet being transferred; and a sticking section for sticking a reinforcing pad on the sheet about the periphery of the filing hole. The perforating section comprises a punch cutter for boring the filing hole in the sheet transferred. The sticking section comprises a delivery part for delivering a reinforcing pad-carrying sheet comprising a releasable base sheet and reinforcing pads which have an adhesive layer and have been stuck on the releasable base sheet at predetermined intervals; a peeling part for acutely bending and reversely turning the reinforcing pad-carrying sheet from the delivery part to peel one of the reinforcing pads gradually from its front end; a catcher having a holding part, which holds the reinforcing pad separated by the peeling part with a holding blade making use of the adhesive layer provided on the reinforcing pad in such a manner that the adhesive layer faces outwardly, and adapted to move the holding part to a sticking region; and a backing pad to be moved following the movement of the holding part of the catcher and having a flexible backing face leading to contact with the holding part with the sheet nipped therebetween.

6 Claims, 5 Drawing Sheets

SHEET PERFORATING APPARATUS

This application is a continuation of application Ser. No. 07/599,112, filed Oct. 11, 1990, now abandoned.

BACKGROUND OF THE INVENTION

1) Field of the Invention

The present invention relates to a sheet perforating apparatus, which can bore at least one filing hole in an edge portion of a sheet such as a design drawing and then automatically stick a reinforcing pad on the sheet about the periphery of the filing hole.

2) Description of the Related Art

In order to keep sheets of a large area such as a design drawing so as to permit their easy handling, it has been carried out to suitably fold the sheets, bore at least one filing hole in their one sides or edges and then file them by a paper fastener.

However, when the folded sheets with the filing holes bored in their one sides or edges are filed by the paper fastener as is, there is a problem that, for example, the portions surrounding each filing hole are disadvantageous-ly worn off or torn, so that the storage durability is deteriorated.

In order to avoid such a disadvantage, it is effective to stick a ring-like reinforcing pad on the sheet about the periphery of the filing hole.

However, since the reinforcing pad has heretofore been stuck manually on the sheet about the periphery of the filing hole, enormous time and labor are required to separately stick reinforcing pads on a large number of sheets. There is hence a problem that difficulties are encountered on a rapid treatment.

SUMMARY OF THE INVENTION

The present invention has been made in view of the aforesaid circumstances and has as its object the provision of a sheet perforating apparatus, which can bore at least one filing hole in an edge portion of each of the sheets and then automatically stick a reinforcing pad on the sheet about the periphery of the hole.

In order to attain the above object, according to this invention, there is thus provided a sheet perforating apparatus comprising a sheet transfer mechanism; a perforating section for boring at least one filing hole in a sheet being transferred; and a sticking section for sticking a reinforcing pad on the sheet about the periphery of the filing hole, said perforating section comprising a punch cutter for boring the filing hole in the sheet transferred, and said sticking section comprising a delivery part for delivering a reinforcing pad-carrying sheet comprising a releasable base sheet and reinforcing pads which have an adhesive layer and have been stuck on the releasable base sheet at predetermined intervals; a peeling part for acutely bending and reversely turning the reinforcing pad-carrying sheet from the delivery part to peel one of the reinforcing pads gradually from its front end; a catcher having a holding part, which holds the reinforcing pad separated by the peeling part with a holding blade making use of the adhesive layer provided on the reinforcing pad in such a manner that the adhesive layer faces outwardly, and adapted to move the holding part to a sticking region; and a backing pad to be moved following the movement of the holding part of the catcher and having a flexible backing face leading to contact with the holding part with the sheet nipped therebetween.

Namely, in this invention, the sticking section is constructed by the delivery part, peeling part, catcher and backing pad. The reinforcing pad-carrying sheet from the delivery part is acutely bent and reversely turned in the peeling part, whereby one of the reinforcing pads is separated gradually from its front end. The reinforcing pad thus separated is held with the holding blade of the holding part of the catcher making use of the adhesive layer provided on the reinforcing pad, and the holding part with the reinforcing pad held thereon is then moved to the sticking region. Thus, the reinforcing pad can be automatically stuck on the sheet about the periphery of the filing hole bored in the sheet in the perforating section.

At least one filing hole is bored in an edge portion of the folded sheet by the punch cutter in the perforating section and the thus-perforated sheet is then transferred to the sticking section.

In the sticking section, the reinforcing pad-carrying sheet is delivered out from the delivery part for the reinforcing pad-carrying sheet, and then acutely bent and reversely turned in the peeling part into a state that only the front end of the reinforcing pad is peeled. The reinforcing pad with its front end peeled is held with the holding blade of the holding part of the catcher making use of the adhesive layer provided on the reinforcing pad in such a manner that the adhesive layer faces outwardly. The reinforcing pad held on the holding part of the catcher is moved to the sticking region. On the other hand, in the sticking region, the backing face of the backing pad is moved following the movement of the holding part of the catcher, so that the sheet passing through between the holding part and the backing face is nipped under pressure therebetween, whereby the reinforcing pad is stuck on the sheet about the periphery of the filing hole.

According to this invention, at least one filing hole is bored in the sheet in the perforating section and subsequently, a reinforcing pad is automatically stuck on the sheet about the periphery of the filing hole in the sticking section. Therefore, it is possible to stick the reinforcing pad more rapidly and exactly than the manual operation.

Other objects and advantages of the present invention will be readily appreciated from the preferred embodiments of this invention, which will be described subsequently in detail with reference to the accompanying drawings.

DETAILED DESCRIPTION OF THE INVENTION AND PREFERRED EMBODIMENTS

Figure 1:
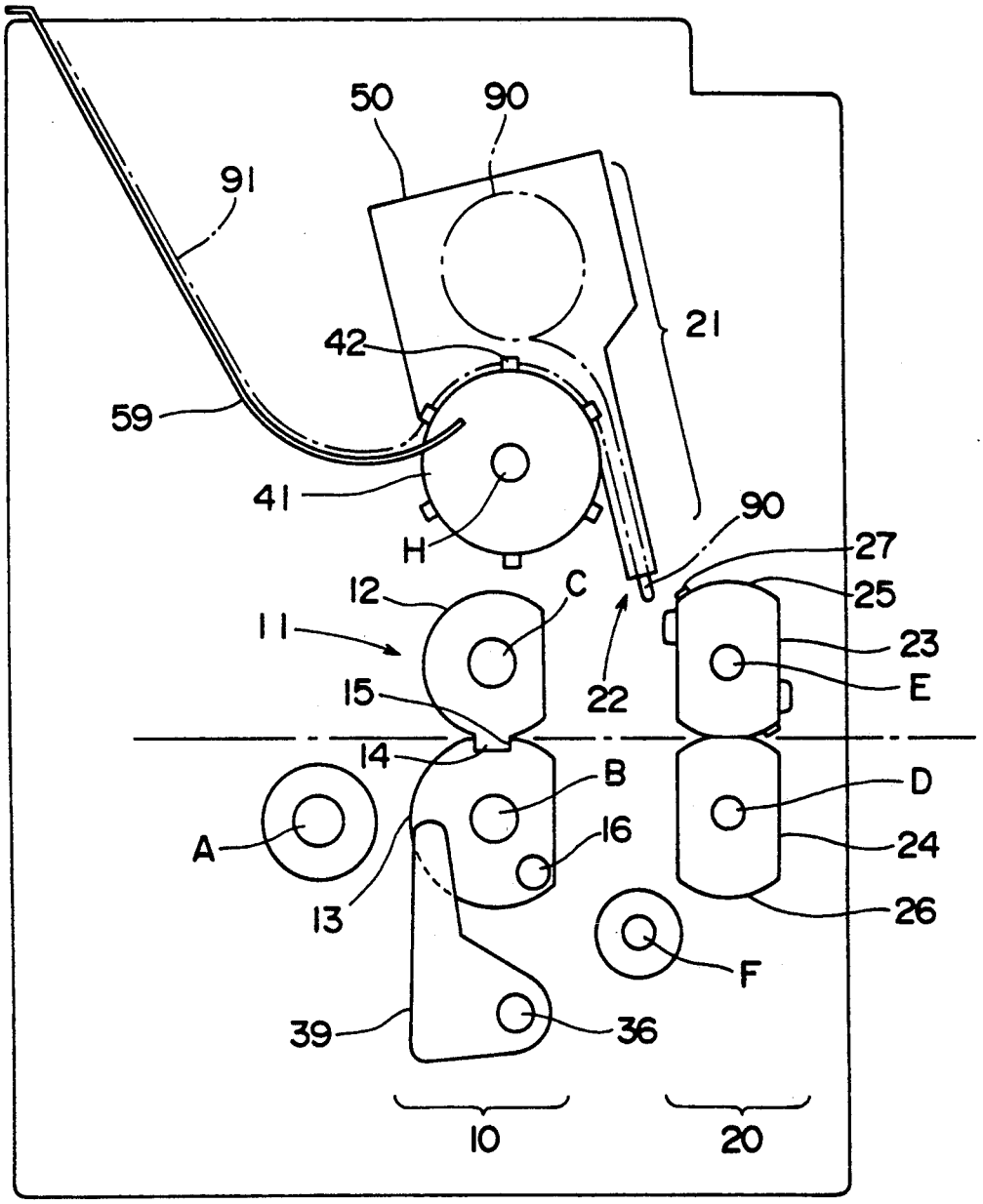
FIGS. 1 and 2 are schematic front and rear elevations, respectively, of a sheet perforating apparatus according to this invention.
Figure 2:
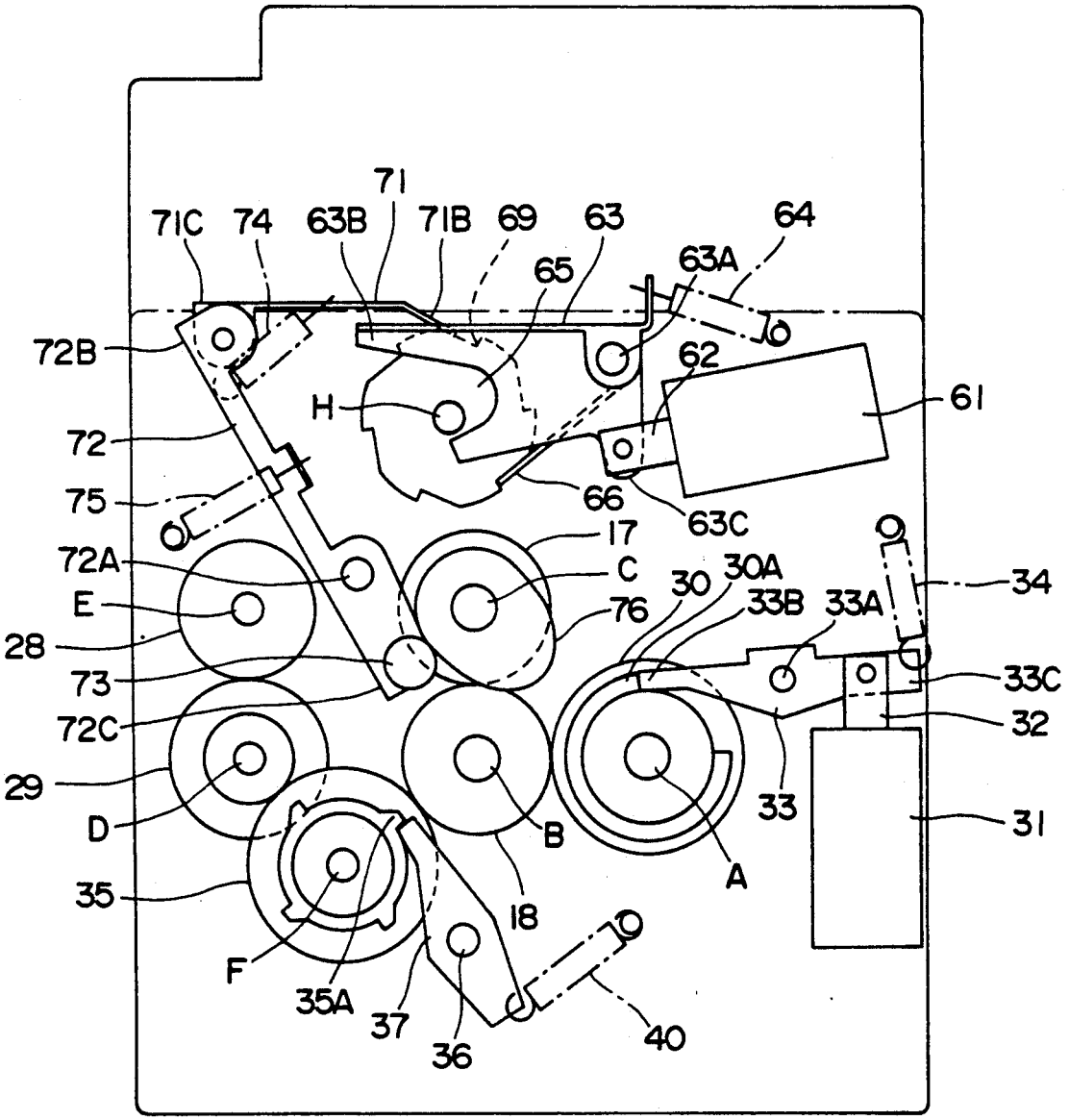

In a sheet perforating apparatus according to one embodiment of this invention, as illustrated in FIGS. 1 and 2, there are provided a perforating section 10 for boring at least one filing hole in a sheet and a sticking section 20 for sticking a reinforcing pad on the sheet about the periphery of the filing hole. Incidentally, FIGS. 1 and 2 are schematic front and rear elevations, respectively, of the sheet perforating apparatus.

The perforating section 10 comprises a punch cutter 11 for boring the filing hole in the sheet transferred.

The sticking section 20 comprises a delivery part 21 for delivering a reinforcing pad-carrying sheet comprising a releasable base sheet and reinforcing pads which have an adhesive layer and have been stuck on the releasable base sheet at predetermined intervals; a peeling part 22 for acutely bending and reversely turning the reinforcing pad-carrying sheet from the delivery part 21 to peel one of the reinforcing pads gradually from its front end; a catcher 23 having a holding part 25, which holds the reinforcing pad separated by the peeling part 22 with a holding blade 27 making use of the adhesive layer provided on the reinforcing pad in such a manner that the adhesive layer faces outwardly, and adapted to move the holding part 25 to a sticking region; and a backing pad 24 which is moved following the movement of the holding part 25 of the catcher 23 and has a flexible backing face 26 leading to contact with the holding part 25 with the sheet nipped therebetween.

The punch cutter 11 of the perforating section 10 comprises a rotary cutter equipped with a cutter member 12 and a backing member 13. The cutter member 12 has one circular edge 14 projecting therefrom. The backing member cutter 13 has a receiving part 15 for receiving the circular edge 14 of the cutter member 12.

Both cutter member 12 and backing member 13 are angularly moved in association with the transfer of the sheet. A circular filing hole is bored in a predetermined position of the sheet by fitting the circular edge 14 in the receiving part 15 in a perforating region.

Described specifically, as illustrated in FIG. 2, gears 17 and 18 are fixed on a rotating shafts C of the cutter member 12 and a rotating shaft B of the backing member 13, respectively, and are meshed with each other. The gear 18 is also meshed with a gear 30 fixed on a rotating shaft A, said gear 30 transmitting turning force to the gears B and C. Namely, the rotating shaft A is connected to a motor (not illustrated) and hence angularly moved thereby, so that the gears 17 and 18 are rotated under control by the rotating shaft A.

The gear 30 has an engaging part 30A. In an engaging condition that one end 33B of a turning lever 33 is engaged with the engaging part 30A, the rotation of the gear 30 is obstructed. To the other end 33C of the turning lever 33, is connected a plunger 32 of a first solenoid 31. Character 33A designates a rotating shaft of the turning lever 33. Numeral 34 indicates a spring which always biases the end 33C of the turning lever 33 in a counterclockwise direction. The first solenoid 31 is actuated by detecting the transfer position of the sheet. When the engaging condition of the turning lever 33 is released by the first solenoid 31, the gear 30 starts rotating. For example, when an optical sensor detects the fact that the rear end of the sheet has passed through, the first solenoid 31 is actuated, and its plunger 32 is attracted, whereby the end 33B of the turning lever 33 is disengaged from the engaging part 30A of the gear 30 and the gear 30 hence starts rotating. By the rotation of the gear 30, the cutter member 12 and backing member 13 of the punch cutter 11 are rotated at the same peripheral speed.

While both cutter member 12 and backing member 13 make a turn, the circular edge 14 is fitted in the receiving part 15 in the perforating region. In this embodiment, both cutter member 12 and backing member 13 are turned twice while one sheet passes through the perforating region, so that two filing holes are bored in the sheet at an interval of, for example, about 80 mm.

In the delivery part 21 for the reinforcing pad-carrying sheet 90, as illustrated in FIG. 1, a cassette 50 with the reinforcing pad-carrying sheet 90 contained in the form of a roll therein is detachably set in a cassette installing part (not illustrated). The reinforcing pad-carrying sheet 90 is stepwise delivered out from the cassette by a delivery wheel 41 which is operated in association with the punch cutter 11.

Figure 4:
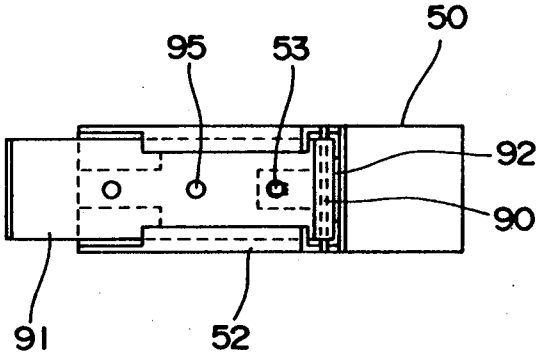
FIGS. 3 and 4 are a vertically sectional front elevation and a bottom plan view, respectively, illustrating an embodiment of a cassette.
Figure 3:
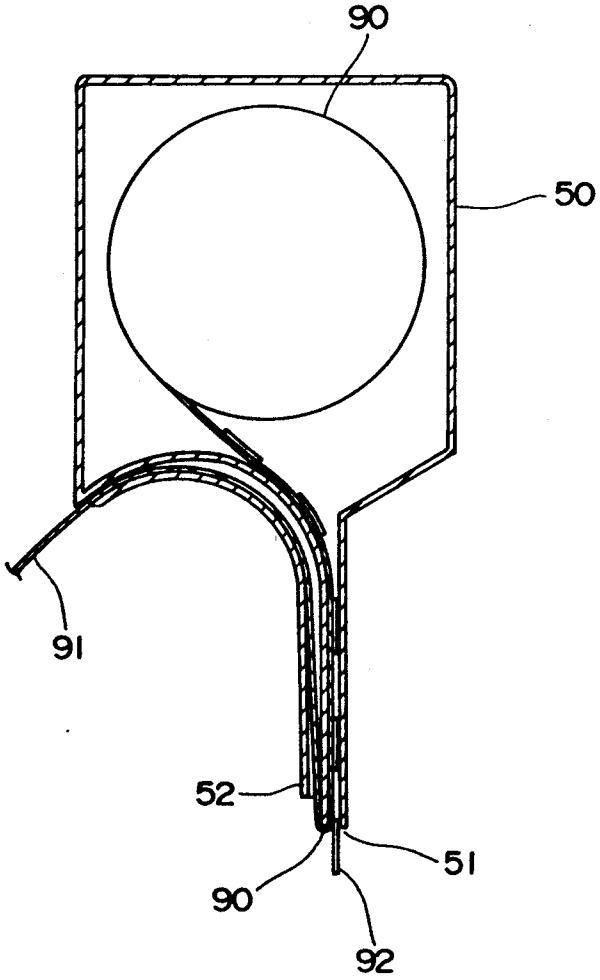

As illustrated in FIGS. 3 and 4, a peeling guide 52 adapted to acutely bend and reversely turn the reinforcing pad-carrying sheet 90 delivered out from a outlet 51 is provided on a side portion of the cassette 50. Numeral 53 is a projection for preventing reverse movement. This projection 53 is fitted in a hole 95 in the base sheet 91, thereby preventing the base sheet 91 from reversely moving. As illustrated in FIG. 1, a guide plate 59 adapted to eject a portion of the base sheet 91, from which the reinforcing pad has been separated, is provided at a position backward of the peeling guide 52.

Figure 5:
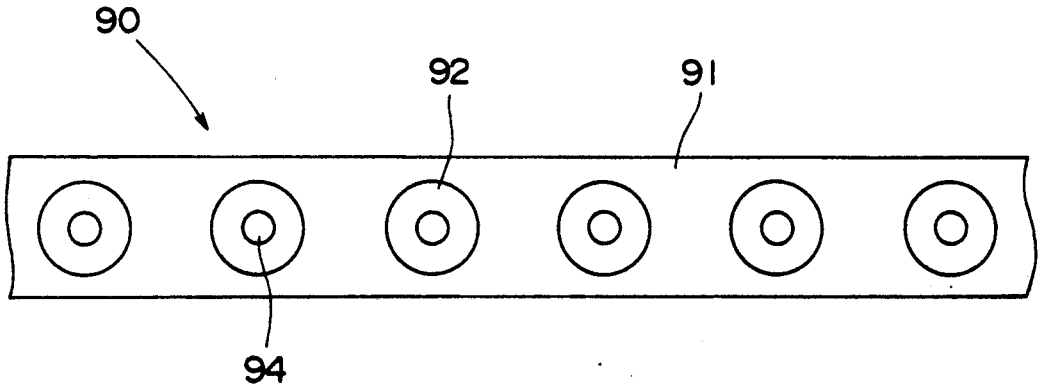
FIGS. 5 and 6 are a plan view and a vertically sectional front elevation, respectively, of a reinforcing pad-carrying sheet.
Figure 6:
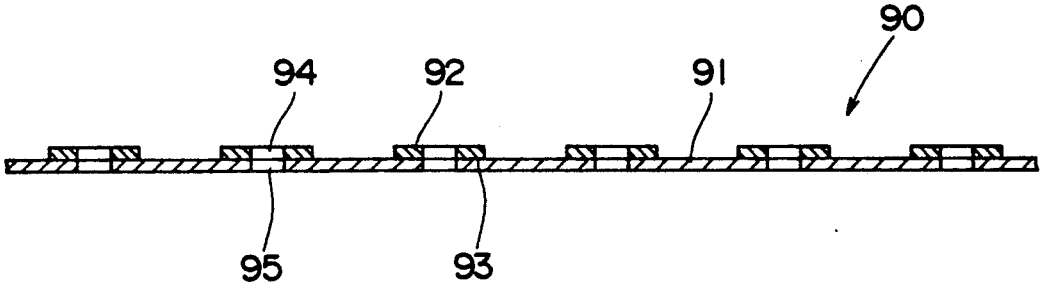
Figure 7:
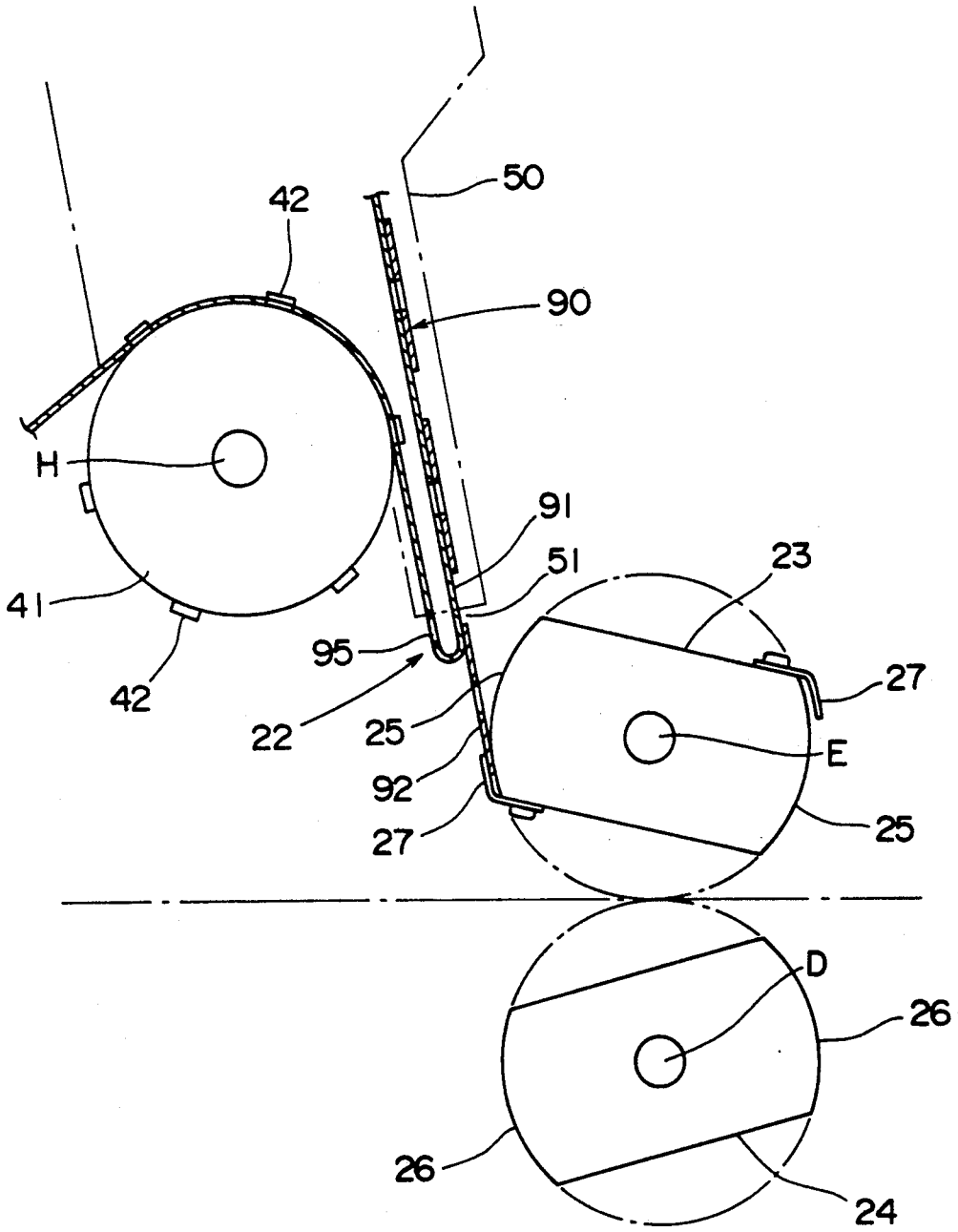
FIG. 7 is a schematic illustration showing principal parts in a sticking section.

As illustrated in FIGS. 5 and 6, the reinforcing pad-carrying sheet 90 comprises a releasable base sheet 91 and reinforcing pads 92 which have an adhesive layer 93 and have been stuck on the releasable base sheet 91 at predetermined intervals. Each of the reinforcing pad 92 is in the form of a ring, in the center of which a hole 94 corresponding to the filing hole in size is defined. Also, holes 95 are respectively bored in portions of the base sheet 91, at which the holes 94 in the reinforcing pads 92 are positioned. As illustrated in FIG. 7, some of engaging projecting parts 42 on the delivery wheel 41 come into engagement with the holes 95 in the base sheet 91, so that the turning force of the delivery wheel 41 causes the base sheet 91 to send out.

As depicted in FIG. 2, a rotating plate 65 with a plurality of inclined teeth 69 provided along the periphery thereof is connected to a rotating shaft H of the delivery wheel 41, and a thrusting lever 71 coming into contact with the inclined tooth 69 to turn the rotating plate 65 by a predetermined angle is provided.

The downward movement of one end 71B of the thrusting lever 71 is controlled by one end 63B of the control lever 63. The control lever 63 is connected, in the other end 63C thereof, to a plunger 62 of a second solenoid 61. When the plunger 62 is attracted by the operation of the second solenoid 61, the end 63B of the control lever 63 is turned in a counterclockwise direction, whereby the end 71B of the thrusting lever 71 is brought to a state that it contacts with the inclined tooth 69 of the rotating plate 65. Character 63A indicates a pivot. Numeral 64 designates a spring which always biases the control lever 63 in a clockwise direction.

The other end 71C of the thrusting lever 71 is pivotally attached to one end 72B of a cam lever 72 and a cam follower 73 is provided on the other end 72C of the cam lever 72. Character 72A indicates a pivot of the cam lever 72. A cam 76 is fixed to the rotating shaft C of the cutter member 12. By the way, the cam lever 72 is always biased at the upper portion relative to the pivot 72A in a counterclockwise direction by a spring 75 and the thrusting lever 71 is urged in a direction coming into contact with the control lever 63 by a spring 74. To the rotating plate 65 in the delivery wheel 41, is attached a stopper pawl 66 for preventing its reversal.

The delivering operation by the delivery wheel 41 will now be described. When the second solenoid 61 is first of all actuated by detecting the transfer position of a sheet, its plunger 62 is attracted, so that the end 63B of the control lever 63 is turned in a counterclockwise direction against the spring 64, whereby the end 71B of the thrusting lever 71, which has been in an idle position, is brought into contact with the inclined tooth 69 of the rotating wheel 65, leading to a state in which the thrusting operation of the inclined tooth 69 by the thrusting lever 71 can be conducted.

On the other hand, while the cutter member 12 of the punch cutter 11 turns once, the end 72B of the cam lever 72 is turned in a clockwise direction in FIG. 2 through the cam follower 73 of the cam 76 which is turned following the rotation of the cutter member 12. By this turning force, the thrusting lever 71 presses the inclined tooth 69 of the rotating plate 65 in the delivery wheel 41 to angularly move the delivery wheel 41 by a predetermined angle.

When the delivery wheel 41 is angularly moved by the predetermined angle, its turning force is transmitted to the reinforcing pad-carrying sheet 90 by the engaging projecting parts on the delivery wheel 41, which have been engaged with the holes 95 in the base sheet, at the position where the reinforcing pad-carrying sheet 90 drawn out from the cassette 50 is acutely bent and reversely turned as illustrated in FIG. 7, whereby the reinforcing pad-carrying sheet 90 is delivered out by a predetermined distance.

Since the reinforcing pad-carrying sheet 90 delivered out from the outlet 51 of the cassette 50 is acutely bend and reversely turned, the reinforcing pad 92 spontaneously peels gradually from its front end owing to its stiffness.

While the backing member 13 of the punch cutter 1 turns once on the other hand, a projection 16 provided on a side of the backing member 13 collides with an turning lever 39 angularly moving on a pivot 36 as illustrated in FIG. 1, whereby the turning lever 39 is angularly moved in a counterclockwise direction. When the turning lever 39 turns in the counterclockwise direction in FIG. 1, a stopper 37, which has been fixed to the pivot 36 at an opposite position as illustrated in FIG. 2, is turned in a clockwise direction to disengage from an engaging part 35A connected to a gear 35, so that the gear 35 starts rotating. The other end of the stopper 37 is always biassed in a counterclockwise direction by a spring 40. Character F indicates a rotating shaft of the gear 35. As the gear 35 rotates, both gears 28 and 29 for the catcher 23 and backing pad 24 start rotating at the synchronous speed with the gear 35. Characters D and E designate rotating shafts of the gears 29 and 28, respectively. The rotation of the gear 35 is controlled by a spring clutch. When the engaging part 35A is engaged with the stopper 37, the spring clutch is made a loosened state, so that the rotation of the gear 35 is stopped. When the stopper 37 is disengaged from the engaging part 35A, the spring clutch is made a tightened state, so that the rotation of the gear 35 is accepted.

As the gear 35 starts rotating, both backing pad 24 and catcher 23 start rotating at the synchronous speed, so that the holding part 25 of the catcher 23 is angularly moved close to the reinforcing pad 92 which lies in a state that it is going to be peeled gradually from its front end while being caused to proceed from the outlet 51 of the cassette 50 in the peeling part 22, as illustrated in FIG. 7. The reinforcing pad 92 delivered out at a speed higher than the turning speed of the holding part 25 is forcedly inserted, from its front end, in a space between the holding part 25 and the holding blade 27 in the catcher 23 until it collides with the back wall of the holding blade 27. In such a state, the adhesive layer 93 on the reinforcing pad 92 adheres to the back surface of the holding blade 27, so that the reinforcing pad 92 is completely separated from the base sheet 91 owing to the adhesion of the adhesive layer 93. Thus, the reinforcing pad 92 is held in a close contact with the surface of the holding part 24 in a posture with the adhesive layer 93 facing outwardly, and is transferred to the sticking region following the holding part 25.

On the other hand, on the backing pad 24 rotated at the synchronous speed with the catcher, is provided the flexible backing face 26 at a position leading to contact with the holding part 25 of the catcher 23 in the sticking region. Since the backing face 26 is flexible, mechanical shock caused by contact with the holding part 25 of the catcher 23 is reduced.

The operation of the catcher 23 and backing pad 24 is controlled through the gear 35 in the basis of the operation of the punch cutter 11. As the filing hole in the sheet reaches the sticking region, the holding part 25 of the catcher 23 and the backing face 26 of the backing pad 24 are brought into contact with each other in the sticking region in a state that the sheet is nipped therebetween, so that the reinforcing pad 92 held on the surface of the holding part 24 is stuck on the sheet about the periphery of the filing hole by its own adhesive layer.

Since two filing holes are bored in one sheet by the punch cutter 11, both catcher 23 and backing pad 24 are also turned twice while the sheet passes through the sticking region, whereby the reinforcing pads 92 are stuck on the sheet about the peripheries of the two filing holes, respectively.

According to the apparatus of the embodiment as described above, two filing holes are bored in an edge portion of a sheet in the perforating section 10 and subsequently, the reinforcing pads 92 are automatically stuck on the sheet about the peripheries of the two filing holes, respectively, in the sticking section 20.

Therefore, it is possible to stick the reinforcing pads 92 rapidly and exactly with less trouble compared with the conventional operation in which the reinforcing pads 92 have been stuck manually.

Besides, the peeling part 22 is constructed in such a manner that the reinforcing pad-carrying sheet 90 from the delivery part 21 is acutely bent and reversely turned to peel the reinforcing pad 92 gradually from its front end, and the reinforcing pad 92 with its front end peeled is transferred to the holding part 25 by the holding blade 27. It is therefore possible to stick the reinforcing pad 92 on the sheet about the periphery of each filing hole with high positional accuracy though the apparatus is simple in construction.

What is claimed is:

1. A sheet perforating apparatus comprising a sheet transfer mechanism; a perforating section for boring at least one filing hole in a sheet transferred; and a sticking section for sticking a reinforcing pad on the sheet about the periphery of the filing hole, said perforating section comprising a punch cutter for boring the filing hole in the sheet being transferred, and said sticking section comprising a delivery part for delivering a reinforcing pad-carrying sheet comprising a releasable base sheet and annular reinforcing pads each having a central aperture reinforcing pads each having a central aperture of a size at least equal to the size of the filing hole, and adhesive layer on one side and releasably secured by said adhesive layer on the releasable base sheet at predetermined intervals; a peeling part for acutely bending and reversely turning the reinforcing pad-carrying sheet from the delivery part to peel one of the reinforcing pads gradually from its front end; a rotatable catcher having a holding part for holding the reinforcing pad separated by the peeling part, said holding part having an arcuate convex surface and a holding blade spaced from said convex surface to engage the adhesive layer provided on the reinforcing pad in such a manner that the adhesive layer faces outwardly from said convex surface, said catcher being adapted to move the holding part to a sticking region; and a backing pad to be moved with movement of the holding part of the catcher and having a flexible backing face to retain the sheet in contact with the holding part.

2. A sheet perforating apparatus as claimed in claim 1, wherein the punch cutter in the perforating section is formed of a rotary cutter having a circular edge.

3. A sheet perforating apparatus as claimed in claim 2, which comprises a gear mechanism for causing the catcher and backing pad in the sticking section to turn in the same direction as the transferring direction of the sheet, said gear mechanism having gears which are rotated in association with the rotary cutter by detecting the rotating position thereof.

4. A sheet perforating apparatus as claimed in claim 1 comprising a sensor for detecting passage of the rear end of the sheet transferred by the sheet transfer mechanism, thereby causing actuation of the punch cutter.

5. A sheet perforating apparatus as claimed in claim 1, wherein the reinforcing pad-carrying sheet is contained as a roll in a cassette and comprising means for receiving the cassette and for delivering said reinforcing pad-carrying sheet stepwise from the cassette in association with the punch cutter.

6. A sheet perforating apparatus as claimed in claim 5, wherein said means for delivering comprises a delivery wheel to delivery the reinforcing pad-carrying sheet from the cassette, a thrusting lever for stepwise driving the delivery wheel and a mechanism for causing the thrusting lever to operate in synchronization with the punch cutter.

* * * * *

UNITED STATES PATENT AND TRADEMARK OFFICE

CERTIFICATE OF CORRECTION

PATENT NO. : 5,188,694

DATED : February 23, 1993

INVENTOR(S) : Yoshisuke Hashida, Hideo Takaoka and Yoshiharu Kamei

It is certified that error appears in the above-identified patent and that said Letters Patent is hereby corrected as shown below:

Claim 1, column 7, lines 10-11, delete "reinforcing pads each having a central aperture";
line 12, change "and" to --an--.

Claim 16, column 8, line 25, change "delivery" to --deliver--.

Signed and Sealed this

Twenty-third Day of November, 1993

*Attest:*

Bruce Lehman

BRUCE LEHMAN

*Attesting Officer*

*Commissioner of Patents and Trademarks*